United States Patent [19]

Matsushita et al.

[11] 4,035,885

[45] July 19, 1977

[54] METHOD FOR PRODUCING MULTI-FIGURE LUMINESCENT DISPLAY TUBES

[75] Inventors: Katsuyuki Matsushita; Hideo Murayama; Kazufumi Yawata; Masaki Kobayakawa, all of Izumi, Japan

[73] Assignee: Nippon Electric Kagoshima, Ltd., Izumi, Japan

[21] Appl. No.: 643,006

[22] Filed: Dec. 22, 1975

[30] Foreign Application Priority Data

Dec. 27, 1974 Japan ..... 50-1875

[51] Int. Cl.[2] ..... H01J 9/02

[52] U.S. Cl. ..... 29/25.14; 29/25.17; 427/55; 427/372 R; 427/379

[58] Field of Search ..... 316/18, 20; 29/25.14, 29/25.17; 427/64, 55, 372, 379 R

[56] References Cited

U.S. PATENT DOCUMENTS

| | | | |
|---|---|---|---|
| 2,273,445 | 2/1942 | Mc Gowan et al. | 316/18 |
| 3,037,834 | 6/1962 | Lederer | 316/19 |
| 3,536,462 | 10/1970 | Eyster et al. | 316/20 |
| 3,576,066 | 4/1971 | Steward | 316/18 |

*Primary Examiner*—Richard B. Lazarus

[57] ABSTRACT

A method for producing multi-figure luminescent display tubes comprising a step of baking a frit glass for fixing parts such as grid electrodes and filament supports onto a substrate which is provided with segment electrodes having phosphor layers applied thereon. The baking process is carried out in a non-oxidizing environment and an infrared heater is used prior to baking to eliminate the frit binder.

3 Claims, 1 Drawing Figure

METHOD FOR PRODUCING MULTI-FIGURE LUMINESCENT DISPLAY TUBES

BACKGROUND OF THE INVENTION

This invention relates to a method for producing multi-figure luminescent display tubes and, in particular, to a method for producing such tubes which can be operated by lower electric power and voltage.

As is well known, a multi-figure luminescent display tube comprises an insulator, and a plurality of groups of segment electrodes. Each group of segment electrodes displays various graphic patterns such as numerals, alphabetic letters or other figures. Each segment electrode is provided with a phosphor layer on the surface thereof. The plurality of groups of segment electrodes are arranged in a plane and are mounted on the insulator.

Filaments are supported on the insulator and extend over, and are spaced from, the plurality of groups of segment electrodes. Between the filaments and the segment electrodes, a plurality of grid electrodes are so disposed that each grid electrode may be over a particular group of segment electrodes. The grid electrodes are, also, supported on the insulator.

The segment electrodes, grid electrodes and filaments are contained in an airtight evacuated envelope. At least one portion of the envelope is transparent so that segment electrodes may be viewed from outside the envelope.

Leads for the filaments, grid electrodes and segment electrodes extend through the insulator to the outside of the envelope.

This display tube is produced by following steps. First, by insulator is prepared and provided with segment electrodes with phosphor layers and leads. Grid electrodes and filament supports are mounted and fixed on the insulator by frit glass. Filaments and getter rods are the fixed to, and supported on, filament supports.

Thereafter, the insulator is fixed to an envelope with a gas exhaust pipe by a frit glass seal so that the segment electrodes, grid electrodes, filaments and getter rods are contained in the envelope. Air in the envelope is exhausted by using the exhaust pipe under the glass baking condition for a predetermined duration, and the exhaust pipe is sealed at a predetermined length.

After the exhaust pipe is sealed off, the getter rods are fashed to evacuate the envelope sufficient to operate the display. Thus the display tube is obtained.

In the step of fixing grid electrodes and filament supports onto the insulator, the frit glass including binder is applied to the grid electrodes, filament supports and the insulator and, then, the frit glass is baked to strongly fix the parts onto the insulator.

The baking step is carried out in oxygen or air to remove the binder by combustion thereof, so that the phosphor layers may be protected from contamination by the binder.

We have found that the baking process in oxygen or air prevents the fabrication of a luminescent display tube having a sufficient brightness. Particularly, phosphor P15 or P24 (designation by the U.S. Radio Manufacturer's Association) used for luminescent display tubes consists of a mixture of ZnO and Zn, and is active. The ratio of ZnO to Zn and the crystal form thereof are varied by heating the phosphor in an oxidizing environment so that the resultant brightness may be varied.

Moreover, the frit glass presents a yellow-white appearance after baking in the oxidizing environment. Accordingly, the frit glass disturbs luminescent display by reflection.

SUMMARY OF THE INVENTION

Accordingly, an object of this invention is to provide a method for producing multi-figure luminescent display tubes having an increased brightness and, therefore, generating a of display using a reduced electric power and voltage.

The method of this invention is characterized by baking frit glass in non-oxidizing environment for fixing parts such as grid electrodes and filaments supports onto an insulator which is provided with segment electrodes having phosphor layers applied thereon. Thus the phosphor layer on the segment electrodes is not heated in an oxidizing environment during the baking process so that the luminous brightness of the phosphor is maintained to be a previously controlled brightness obtaining at the time the phosphor layers were deposited on the segment electrodes. Therefore multi-figure luminescent display tubes can be obtained which have an increased brightness.

Furthermore, a Pb component precipitates from the frit glass by baking in the non-oxidizing environment and the baked frit glass presents a dark-gray appearance, so that a high contrast display may be secured.

The other objects and features of this invention will be understood from following descriptions of embodiments of this invention referring to the annexed drawing.

DETAILED DESCRIPTION OF PREFERRED EMBODIMENTS

Figure 1:
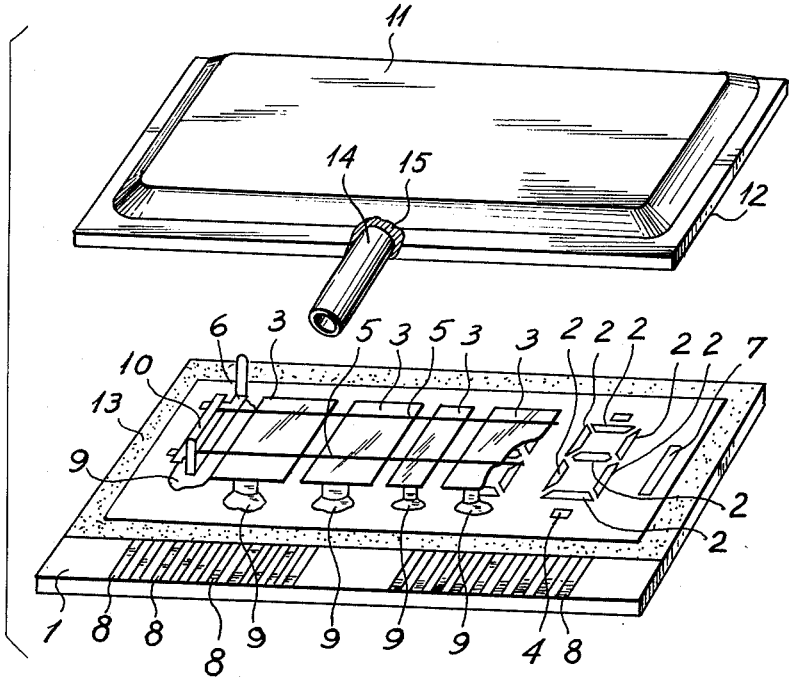
FIG. 1 shows a perspective view of a multi-figure luminescent display tube, drawn in disassembled and partially broken form, for describing a known method and a method of this invention.

FIG. 1 shows a five-figure luminescent display tube. This tube comprises an insulator substrate 1 of a ceramic plate such as an alumina plate, a forsterite plate, or a glass plate. The substrate 1 is provided with five groups of segment electrodes 2 with phosphor layers applied on the electrodes for displaying numerals, terminals 4 for connecting grid electrodes 3 thereto (one being shown in the drawing), another two terminals 7 (one being shown) to which two supports 6 (one of them is shown) for filaments 5 are connected, and other terminals 8 used for connecting this composite display tube with a peripheral circuit and which are connected with segment electrodes and terminals 4 and 7 respectively.

Grid electrodes 3 are connected to corresponding terminals 4 by a silver paste or an aquadag and are fixed onto the substrate 1 by means of a frit glass 9 in such fashion that each grid electrode 3 may extend over each corresponding group of segment electrodes 2. Filament supports 6 are fixed onto the substrate 1 by a frit glass 9 and are connected with corresponding terminals 7 by a silver paste or an aquadag. Filaments 5 (two filaments are shown) are secured on filament supports 6 to extend over all of grid electrodes 3. Filamaent supports 6 also support getter substance rods 10.

A cover 11 of a transparent glass is formed with a depressed portion at the central portion and a flanged portion 12 at the circumference thereof. The glass cover 11 is put onto the substrate 1 and fixed thereto by sealing between the flanged portion 12 and the sealing margin 13 of the substrate by a frit glass, with grid electrodes 3, filaments 5 and filament supports 6 being contained in the depressed portion of the cover.

A known method for producing the display tube comprises steps of;

1. preparing an insulator substrate 1 having segment electrodes 2 with phosphor layers thereon, terminals 4 and 7 for connection to grid electrodes 3 and filament supports 6, and terminals 8 connecting with segment electrodes 2 and terminals 4 ad 7;

2. connecting grid electrodes 3 and filament supports 6 with corresponding terminals 4 and 7 by a silver paste or an aquadag, and applying a frit glass 9 on the connecting portions;

3. putting the substrate 1 into a baking furnace and baking the frit glass 9 to secure grid electrodes 3 and filament supports 6 on the substrate;

4. mounting filaments 5 and getter substance rods 10 onto filament supports 6 by welding after taking the substarate out of the furnace;

5. putting the glass cover 11, which is provided with an exhaust pipe 14 by a frit glass 15, onto the substrate with the flange portion 12 applied a frit glass being in registration with the sealing margin 13 of the substrate and with the cover 11 containing grid electrodes 3, filaments 5, filament supports 6 and getter rods 10 in the depression of the cover;

6. putting the substrate 1 and cover 11 into a furnace and baking frit glass to effect a secure seal between the substrate 1 and the glass cover 11 to obtain a semimanufactured display tube;

7. exhausting air in the semimanufactured tube utilizing the exhaust pipe 14 ad the getter substance 10 and sealing the pipe 14 at a predetermined length.

In this known method, the baking in step (3) above is carried out in an oxidizing environment such as oxygen or air to remove a binder mixed in the frit glass by combustion thereof so that the phosphor layers may be protected from contamination by the binder.

However, baking in the oxidizing environment degrades the luminous brightness of the phosphor, as above described.

According to the present invention, the baking in step (3) above is carried out in a non-oxidizing environment such as a nitrogen environment or an inactive gas, for example, an argon environment. Thus the luminous property of the phosphor layers is not affected in the baking process of the frit glass so that a sufficient luminous brightness of the phosphor layers may be maintained, which has been controlled when the phosphor layers was deposited on segment electrodes 2. This increases the brightness of display developed by the display tube.

In particular, since a previously controlled luminescence brightness of the phosphor layers can be maintained by conducting the baking process in step (3) above in a non-oxidizing environment, the conditions for baking the phosphor layers to control the luminous brightness thereof at the time when the phosphor layers are deposited onto segment electrodes 2 can be selected to realize maximum luminous brightness for the phosphor, if the substrate 1 can support such a condition. A forsterite plate is superior to a glass plate for the substrate 1 because the former can endure a higher temperature than the latter.

Another advantage of the method of this invention is to prevent degradation of the filaments 5. Heating filaments in an oxidizing environment degrades carbonates in the filaments, thus deteriorating the electron emitability of filaments. This disadvantage can be avoided according to the present invention.

A further advantage of this invention is that the grid electrodes 3 and filaments supports 6 can be protected from oxidation. This results in a long life time for the tube because gas radiated by impact, of electrons on these parts is reduced.

Another advantage is that the baked frit glass presents a dark-gray appearance because of the precipitation of the Pb component from the frit glass. Thus a high contrast display can be secured.

The binder mixed in the frit glass cannot be removed by carrying out the baking process in above step (3) in non-oxidizing environment. However, the binder can be readily removed by provision of a far infrared ray heater just before the baking process.

It will be noted from above description that multi-figure luminescent display tubes are obtained by this invention, which can be operated by reduced electric power and voltage. Actually, according to this invention, we could economically produce nine-figure display tubes which operate by application of voltage pulse of 22 – 24 V and with a power consumption of 10 m W per figure.

This invention has been described referring to a particular luminescent display tube of a special structure. However, this is only an example for purposes of description. It is understood by those skilled in the art that this invention can be applied to a method for producing multi-figure luminescent display tubes which comprises a step of fixing parts such as grid electrodes and filament supports by a frit glass onto an insulator with segment electrodes having phosphor layers applied thereon.

We claim:

1. A method for producing a multi-figure luminescent display tube, comprising the steps of preparing an insulator body including segment electrodes having phosphor layers applied thereon, baking the phosphor layers to control their luminous brightness, assembling parts onto the insulator body, and applying a frit glass mixed with a binder on connecting portions between the parts and the insulator body, placing the insulator body on which the parts are assembled into a baking furnace, baking the frit glass to stably fix the parts onto the insulator body, and sealing the insulator body to a container with the parts affixed to the insulator body being covered by the container, the improvement comprising removing the binder by heating the frit glass mixed with the binder applied on connecting portions between the parts and the insulator body by an infrared ray heater prior to said baking step, and wherein said baking step comprises baking the frit glass in a non-oxidizing environment in the baking furnace to stably fix the parts onto the insulator body to maintain the previously controlled luminous brightness of the phosphor layers.

2. The method as claimed in claim 1, wherein said non-oxidizing environment is an atmosphere selected from the group consisting of nitrogen and argon.

3. The method as claimed in claim 1, wherein said insulator body is a forsterite plate.

* * * * *